United States Patent [19]

Gorrow

[11] 4,244,586

[45] Jan. 13, 1981

[54] FOUR-IN-ONE SCOPE SIGHTING-IN TARGET

[75] Inventor: Bernard J. Gorrow, Crawford Bay, Canada

[73] Assignee: W. B. Lambert, Lethbridge, Canada

[21] Appl. No.: 29,487

[22] Filed: Apr. 12, 1979

[30] Foreign Application Priority Data

Jun. 14, 1978 [CA] Canada ..... 305482

[51] Int. Cl.[3] ..... F41J 1/04

[52] U.S. Cl. ..... 273/409; 273/408

[58] Field of Search ..... 273/102 R, 102 PM, 101.2, 273/408, 409; 33/293, 294

[56] References Cited

U.S. PATENT DOCUMENTS

| | | | |
|---|---|---|---|
| 626,500 | 6/1899 | McCullough | 273/101 |
| 738,790 | 9/1903 | Gaudet | 273/102 PM |
| 3,118,674 | 1/1964 | Curren | 273/102 PM |

FOREIGN PATENT DOCUMENTS

| | | | |
|---|---|---|---|
| 907300 | 6/1945 | France | 273/248 |
| 586743 | 3/1947 | United Kingdom | 273/102 PM |

*Primary Examiner*—Anton O. Oechsle

*Attorney, Agent, or Firm*—Wenderoth, Lind & Ponack

[57] ABSTRACT

Hunting rifles must be sighted-in for accuracy at long range and such a procedure is complicated by the scarcity of long range firing ranges. The invention simplifies the sighting-in procedure on short rifle ranges and provides for the sighting-in of rifles equipped with telescopic sights. This is accomplished by the use of a sighting-in target having a cross comprised of equal length horizontal and vertical lines intersecting at their midpoints. The lines are provided at the ends thereof with markings in the form of solid-colored circles circumscribed by concentric rings.

1 Claim, 6 Drawing Figures

FOUR-IN-ONE SCOPE SIGHTING-IN TARGET

FIELD OF THE INVENTION

This invention relates to a target which can be used for sighting-in of rifles equipped with telescopic sights, which target allows for sighting-in for a distance greater than the available range between the rifle and the target.

BACKGROUND OF THE INVENTION

A hunting rifle must be sighted-in for a selected range to enable accurate firing at long distances. Hunters require their firearms be sighted-in for a range of 200 to 300 yards, which presents a problem. There are very few such long ranges available for this purpose, thus hunters must sight-in on shorter ranges and make compensation. The standard range is usually only 100 yards long. The present invention overcomes this problem by providing a target which enables the accurate long-range sighting-in of rifles equipped with telescopic sights, on a much shorter firing range. The traditional bull's-eye target was originally designed for use with open sight and peep sight rifles. This target is unsuitable for sight-in a rifle with a telescopic sight because it requires the rifleman to align the cross-wires with an arc of one of the concentric circles of the target. That procedure is awkward and imprecise. The present invention overcomes these limitations of the prior art.

SUMMARY OF THE INVENTION

The invention provides a sighting-in target for a distance greater than the available range between the firearm and the target, said target having a cross comprised of a vertical line and a horizontal line intersecting therewith, and at least one marking defining an impact point aligned with said vertical line and spaced above the intersection of the horizontal and vertical lines a predetermined distance.

The following drawings illustrate embodiments of the invention.

DETAILED DESCRIPTION OF THE PREFERRED EMBODIMENT

Figures 1A, 1B, 1C, 1D:
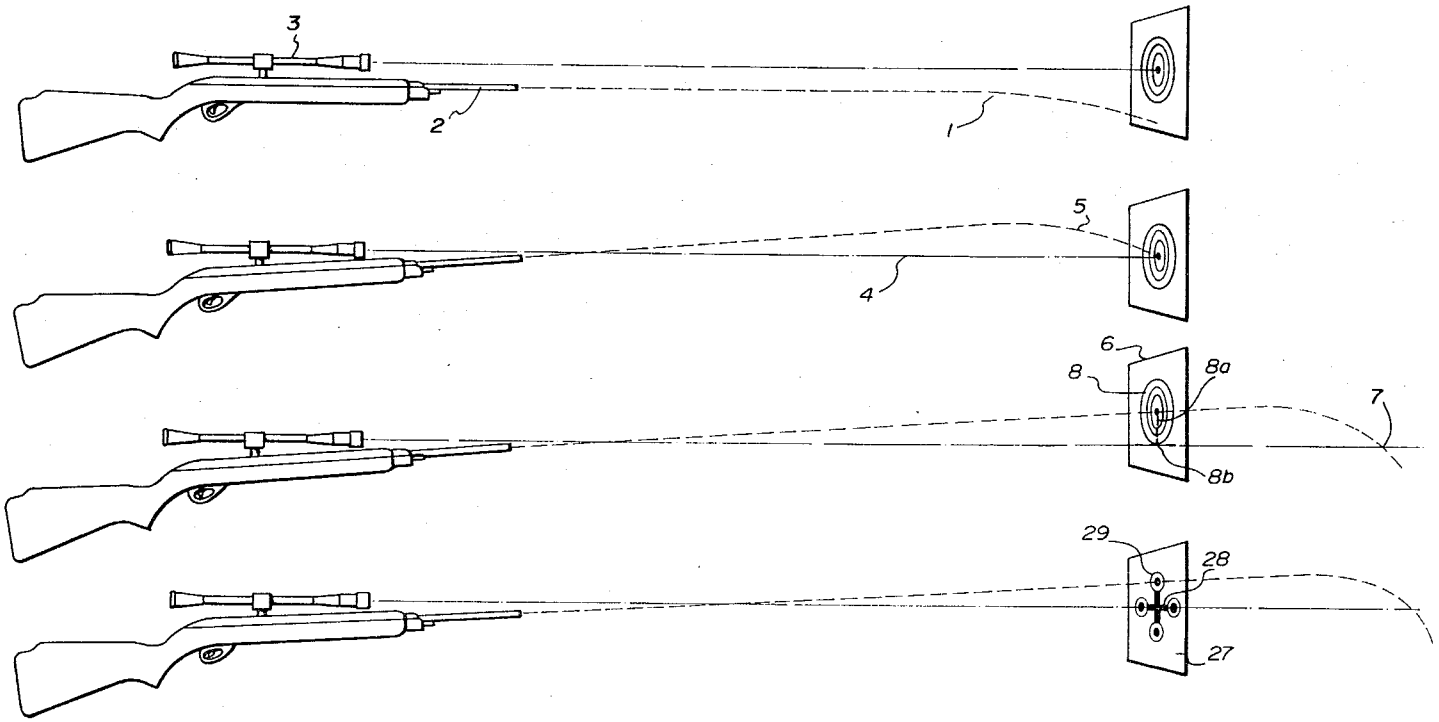
FIG. 1a PRIOR ART
FIG. 1b PRIOR ART
FIG. 1c PRIOR ART
FIG. 1*a* is a diagrammatic representation of a rifle sighted on a distant target at full range, with the telescopic sight parallel to the rifle; the gravity-affected trajectory path of a bullet being shown by a dotted line; the target is shown rotated from its actual position and both the rifle and the target are on a greatly enlarged scale with respect to the range distance.
FIG. 1*b* is a similar diagrammatic representation of a rifle sighted on a distant target showing a compensation method of firing.
FIG. 1*c* is a diagrammatic representation showing the difficulties of sighting-in a rifle, with a conventional target, on a short range.
FIG. 1*d* is a diagrammatic representation of a range similar to FIG. 1*c* but with the target of the invention.

Long range hunting rifles must be sighted-in high due to the effect of gravity on a projectile, the actual trajectory being represented by the dotted line 1 of FIG. 1*a*. The path of the fired projectile is never straight but follows a downward path as the velocity falls off; thus it is not precisely parallel with the line of sight. Firing at long range targets requires compensation for this effect of gravity and further compensation for the average telescopic sight 3 being situated about 1½ inches above the rifle bore 2. Compensation is made by firing at an angle to the line of sight 4 (FIG. 1*b*) to allow the projectile to trace out its inverted catenary flight path 5 as its velocity falls off, and have it again intersect with the line of sight 4 at the distant target. The second intersection of the bullet with the line of sight is the desired range for sighting. The range at which this event occurs can be modified by adjusting the elevation of the horizontal cross-wires in the telescopic sight relative to the rifle bore. Given a long rifle range, this exercise is a simple matter, but the standard shorter target range makes for difficulties. In this situation the target will lie substantially nearer to the marksman than the sighting-in range (that point where the trajectory of the bullet again crosses the line of sight). As shown in FIG. 1*c*, the bullet will strike the target 6 above the point 8 where the line of sight crosses that target 6. In other words, the rifleman sights on one point of the target and attempts to hit another point of the same target.

Figure 3:
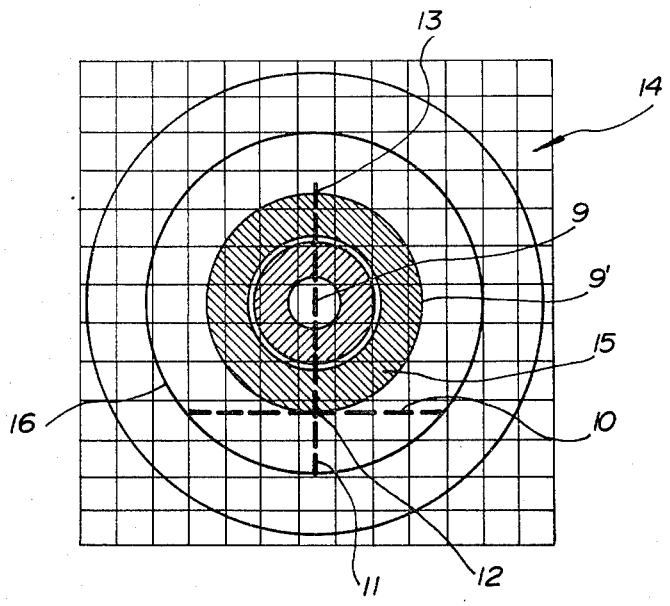
FIG. 3 PRIOR ART
FIG. 3 shows the conventional bull's-eye target.

In the prior art, marksmen would aim at a target about 100 yards away, fire several rounds and obtain a cluster of shots on the target card called a shot grouping. The goal was to obtain a tight group situated 3 inches above the centre of the bull's-eye. This 3 inch adjustment would allow for a killing shot on a deer-size animal at a range of up to 300 yards, using most modern high velocity rifles. This procedure is crude and carrying it out with a telescope sighted rifle presents further problems. If the rifleman attempts to place his bullets in the centre 8*a* of the bull's-eye 8 of FIG. 1*c*, and 9 of the bull's-eye 15 in FIG. 3, he will have to aim the cross-hairs of the telescopic sight, 10–11 of FIG. 3, 3 inches below centre 9 at point 12 on the arc of the circumference 16 of the bull's-eye 15 of a standard target 14 (see point 8*b* in FIG. 1*c*). Such a procedure requires a rifle handler to hold the horizontal cross-hair 10 at a tangent to the arc of the circumference 16 and simultaneously have the vertical cross-hair 11 bisect the bull's-eye on a line 12-9 which passes through the centre 9 of the bull's-eye 15. The rifleman's attention is necessarily divided between two separate and difficult sighting alignments, and this tends to interfere with the concentration and coordination required for a well-placed shot. The rifleman can reverse this procedure by sighting the cross-hairs at centre 9 and striving to place a group of shots directly 3 inches above the centre of the bull's-eye 9 at point 13 on the edge of the black bull's-eye 15. This also is a difficult procedure, requiring undue concentration, and scoring must be done on an undefined point 13 on the circumference of the circle 16 which is a poor substitute for the centre of the bull's-eye.

Figure 2:
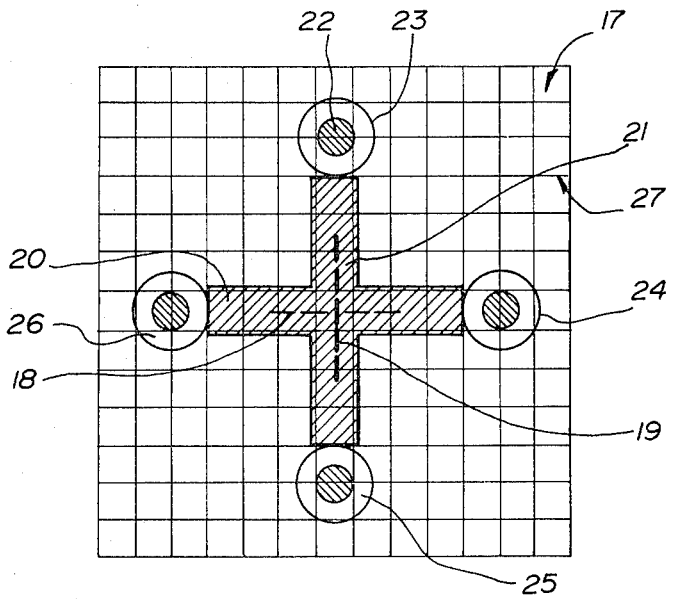
FIG. 2 shows the target of the invention.

The target of the invention, shown at 17 in FIG. 2 and 27 in FIG. 1*d*, avoids these problems. With the target of the invention the gun handler sights on the cross 28 of FIG. 1*d* at 100 yards range and attempts to hit circle 29. In so doing, the rifleman aligns the cross-hairs of his scope sight 18–19 to coincide with the centre cross bars 20–21 of FIG. 2 and tries to fire a grouping of shots at circle 22 within circle 23. If the rifle is not properly sighted, elevation and windage adjustments can be made with the aid of the faint graph one inch squares 27, of the target 17, in order to centre the point of impact on circle 22. In this manner, the standard 3 inch elevation above the centre of a target can be easily obtained. The target design of the invention does not preclude the use of rifles equipped with a telescopic sight which features a post or dot reticule. The target of the invention can be re-used by rotating it 90° and firing at the circle 24, 25 or 26. In this manner the target may be used for four separate procedures. In different embodiments of the invention the length of the cross bars 20–21 may be modified or the circles 23, 24, 25 and 26 repositioned to allow for different target ranges or different sighting-in ranges.

What I claim as my invention is:

1. A sighting-in target for a distance greater than the available range between the firearm and the target, said target having a cross comprised of a vertical line and a horizontal line intersecting therewith;

said target further comprising four markings in the form of solid-coloured circles, each circle being circumscribed by a concentric ring, the vertical and horizontal lines being of equal length, intersecting at their mid-points and said rings and corresponding circles being located one each at the four ends of said lines, wherein at least one of said markings defines an impact point.

* * * * *